US005618211A

United States Patent [19]

Bourgoin

[11] Patent Number: 5,618,211

[45] Date of Patent: Apr. 8, 1997

[54] APPARATUS FOR AND A METHOD OF CONTROLLING THE SPEED OF A SHIP

[75] Inventor: Jean-Pierre Bourgoin, St Nazaire, France

[73] Assignee: S.E.M.I. Pielstick, Saint-Denis, France

[21] Appl. No.: 587,930

[22] Filed: Jan. 17, 1996

[30] Foreign Application Priority Data

Jan. 19, 1995 [FR] France ..... 95 00589

[51] Int. Cl.[6] ..... B63H 23/10

[52] U.S. Cl. ..... 440/4; 440/1; 440/87; 440/75

[58] Field of Search ..... 440/1, 3, 4, 6, 440/49, 74, 75, 84, 86, 87; 114/145 A

[56] References Cited

U.S. PATENT DOCUMENTS

| | | | |
|---|---|---|---|
| 4,368,048 | 1/1983 | Wedler | 440/4 |
| 4,403,968 | 9/1983 | Heidrich et al. | 440/4 |
| 4,451,238 | 5/1984 | Arnold | 440/74 |
| 4,458,799 | 7/1984 | Schueller | 440/74 |
| 5,413,512 | 5/1995 | Belenger | 440/74 |

FOREIGN PATENT DOCUMENTS

| | | |
|---|---|---|
| 2370631 | 6/1978 | France . |
| 3505992A1 | 8/1986 | Germany . |
| 415432A1 | 2/1993 | Germany . |

*Primary Examiner*—Stephen Avila
*Attorney, Agent, or Firm*—Sughrue, Mion, Zinn, Macpeak & Seas

[57] ABSTRACT

A method and apparatus for controlling the speed of a ship optimizing the configuration of its drive system, e.g., including its engine, geartrain, brake, clutch and screw.

4 Claims, 1 Drawing Sheet

APPARATUS FOR AND A METHOD OF CONTROLLING THE SPEED OF A SHIP

The invention relates to an apparatus for and to a method of controlling the speed of a ship fitted with drive means.

BACKGROUND OF THE INVENTION

The drive means to which the present document relates comprise at least one of each of the following elements;

- a reversible internal combustion engine,
- a step-down geartrain driven by the engine,
- a friction-type clutch allowing the engine to be decoupled from the step-down geartrain,
- a shaft line driving a screw propeller with fixed blades, and
- a friction-type brake allowing the shaft line to be decelerated and held stationary.

The speeds ahead and astern of ships fitted with a drive mechanism of this type are controlled by acting on the speed and the direction of rotation of the engine and therefore of the screw, and any change of those two parameters may require combined or successive operation of the clutch and the brake. Changing the speed of the engine requires the load which will be imposed on the engine after it has changed speed to be predicted, it being evident that a load greater than the available engine torque could cause the engine to stall. Operating the brake and the clutch causes a portion of the mechanical power which they convey to be transformed into heat. If the heat dissipation limit is exceeded, then the torque transmissible by those members diminishes, this being followed by irreversible damage to some of their component parts.

Numerous parameters must therefore be taken simultaneously into account in order to control the ship, this being complicated even further if the drive mechanism comprises, for example, two engines driving a single shaft line via a step-down geartrain which transmits power from one or both engines to the shaft line. In this case, depending on the set speed, one of the engines may, for example, be disengaged and stopped.

The most frequently encountered situations and ship speeds are as follows:

- maneuvering (dead slow) ahead and astern,
- running ahead, from a standstill to full speed,
- braking and stopping the ship in a minimum distance, a situation known as a "crash-stop",
- sudden unavailability of one engine where the drive mechanism comprises a plurality of engines.

OBJECTS AND SUMMARY OF THE INVENTION

An object of the present invention is therefore to provide a method of controlling the speed of a ship which assists in control of the ship by automating the process of choosing the best configuration of the drive mechanism to meet the requested speed, whilst complying with performance limits and the availability of engines, brakes, and clutches.

The invention provides a method of controlling the speed of a ship, said ship being fitted with drive means and means for optimizing the configuration of said drive means, said drive means comprising at least one reversible internal combustion engine, a speed step-down geartrain driven by said engine, a friction-type clutch allowing the engine to be decoupled from said associated step-down geartrain, a shaft line driving a screw propeller with fixed blades and a brake allowing the shaft line to be decelerated and held stationary, said method comprising the steps consisting of:

- choosing a desired speed for the ship,
- measuring the present speed of the ship and the parameters representing the operation of the engine, geartrain, brake, clutch, and screw,
- and comprising the additional steps consisting of:
  - comparing the measured values of said present ship speed and said parameters representing the operation of the engine with the values of the same parameters which would result from compliance with the desired ship speed; and
  - sending commands for changing the states of the engine, the brake and the clutch as required to obtain said values of said parameters resulting from said desired ship speed, said commands for changing the states of the engine, the brake, and the clutch being determined so that the performance required of the engine, the brake or the clutch as a result, does not exceed the maximum performance permitted for any of those components.

The method of controlling the speed of a ship in accordance with the invention also satisfies either of the following characteristics:

- said values of said performance limits for the engine, the brake and the clutch are calculated before sending each state-changing command, said calculation consisting, for the engine, in determining the maximum torque which is potentially available and the law for obtaining this torque from the present state of the engine, and, for the clutch and the brake, in determining the amount of heat energy which can still be carried by these components, taking into account their present thermal state and the number of operations which they have already performed,
- a clutch engagement operation is performed at the same time as an operation in which engine torque is increased, so as to allow said engine torque to establish itself whilst minimizing the heat energy generated by the clutch.

According to another essential characteristic of the invention, the apparatus for controlling the speed of a ship, in particular for implementing the method of the invention, is intended most particularly for a ship including drive means comprising at least one reversible internal combustion engine, a speed step-down geartrain driven by said engine, a friction-type clutch allowing the engine to be decoupled from said associated step-down geartrain, a shaft line driving a screw propeller with fixed blades and a brake allowing the shaft line to be decelerated and held stationary, said apparatus comprising means for optimizing the configuration of the drive means.

One advantage of the method of the invention for controlling the speed of a ship is that operational capacity can be calculated continuously.

Another advantage of the method of controlling the speed of a ship in accordance with the invention is that the operator can be given an indication of the optimum configurations of the drive mechanism.

A further advantage of the method of controlling the speed of a ship in accordance with the invention is that the configuration can be adapted automatically to the desired speed of the ship.

BRIEF DESCRIPTION OF THE DRAWING

Other objects, characteristics and advantages of the invention will become apparent from reading the description of the apparatus for and the method of controlling the speed of a ship, this description being given in conjunction with the accompanying drawing in which.

MORE DETAILED DESCRIPTION

Figure 1:
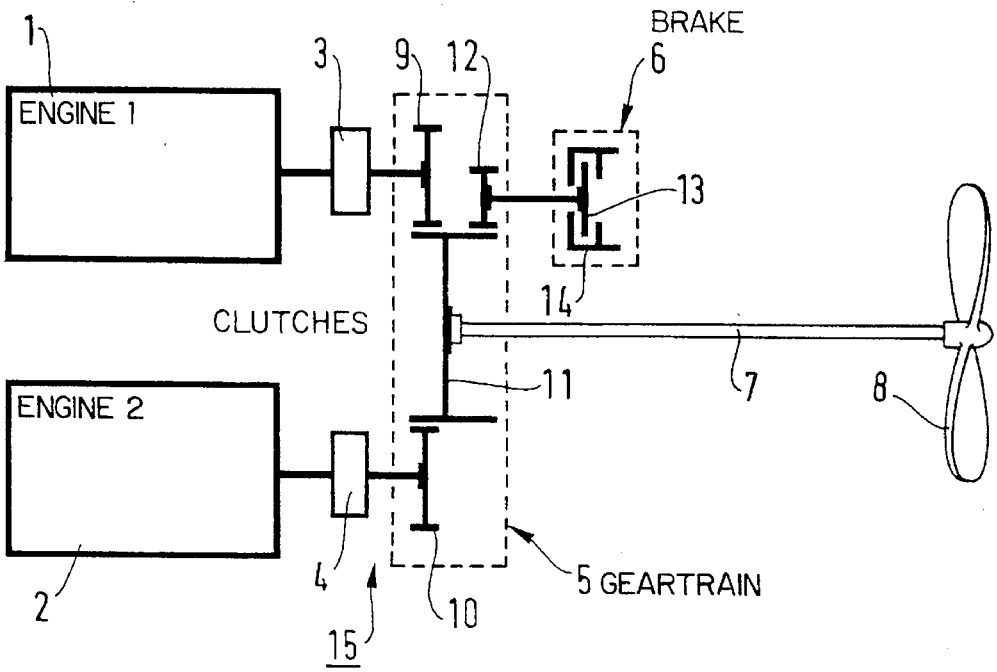
FIG. 1 shows in schematic form and by way of example, a drive mechanism.

FIG. 1 shows in schematic form by way of example a drive mechanism 15 comprising two engines 1, 2, each connected to a single speed step-down geartrain 5 via a respective friction-type clutch 3, 4 allowing each engine to be selectively isolated from the step-down geartrain.

The step-down geartrain is constituted by two toothed inlet gears 9 and 10 connected to the clutches 3 and 4 respectively. These gears co-operate with a single outlet gear 11.

The outlet from the step-down geartrain 5 drives a shaft line 7 connected to a gear 11.

A fixed-blade screw propeller is provided at the end of the shaft line 7 remote from the step-down geartrain.

The gear 11 is connected via an inlet gear 12 to a friction brake 6 constituted by a disk 13 which can be held stationary by clamping jaws 14.

Figure 2:
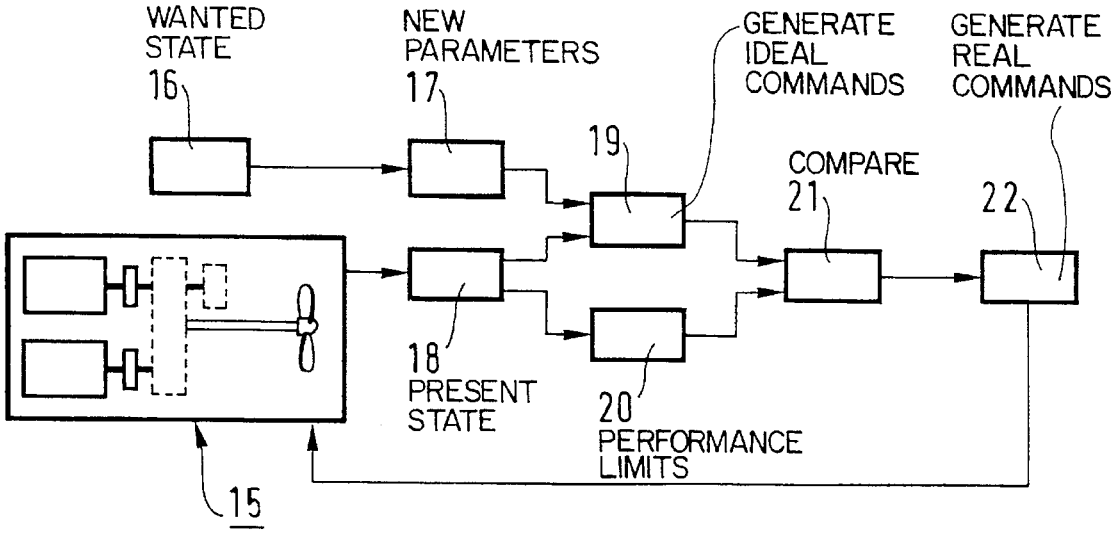
FIG. 2 illustrates an acquisition circuit in accordance with the invention.

In accordance with the invention, FIG. 2 illustrates an acquisition and processing circuit, for acquiring the desired values and the values of the operational parameters of the components of the drive mechanism 15, and also for generating the state-changing commands, as indicated by the blocks numbered 16 to 22.

By way of example, the execution of an operation which consists in proceeding from travel ahead to travel astern is now described.

Assuming the ship is moving ahead, the engine 1 is connected and is providing drive, the engine 2 is disconnected and is idling in the direction of rotation corresponding to the ship moving astern. The desired values, such as the new travel direction and the final speed and possibly the availability of certain members, are recorded in block 16.

These values are transmitted to block 17 where they are processed in order to derive the values which the operational parameters of the components of the drive mechanism must take in order to comply with the desired values. The present operational parameters of the components of the drive mechanism 15 are recorded in block 18, these parameters including in particular the temperatures of the friction members for the clutches and the brake, and the present speed of the ship, and the torque which the screw will deliver when it is disconnected from the engine 1 is also calculated. The nature and the theoretical values of the state-changing commands to be sent to the drive mechanism are determined in block 19, these being derived by comparing the values resulting from the processing carried out in blocks 17 and 18. The performance limits Of the components of the drive mechanism 15 are determined in block 20, from the values provided by block 18. The theoretical values from block 19 are compared in block 21 with the limit values from block 20, and the state-changing commands are determined as ultimately compatible with the present state of the components of the drive mechanism.

The limitations may for example relate to the heat energy which the brake can dissipate, which may be less than the heat energy which would be produced by the force of the torque delivered from the screw. It will then be necessary to either limit the braking torque, or not to brake at all and to wait for the natural deceleration of the ship to obtain torque from the screw which can be accepted by the brake. If the brake is unavailable at that moment, it is necessary to verify that the present torque from the screw is compatible with the predicted torque of the engine 2 rotating in the appropriate direction, and to this end the engagement torque of the clutch is adjusted so as to allow the engine 2 enough time to produce sufficient useful torque after disengaging the engine 1, it being possible to accelerate the production of this torque by known means.

The state-changing commands are then provided to block 22 which transmits them to the various members of the drive mechanism 15 for execution, whilst informing the person in charge of the ship. At this time, that person may allow execution to proceed or may change or cancel all or some of the commands determined by the processing system.

The apparatus for controlling the speed of a ship in accordance with the invention, in particular for implementing the method of the invention, is intended most particularly for a ship which includes drive means 15 comprising at least one reversible internal combustion engine 1, 2, a speed step-down geartrain 5 driven by the engine, a friction-type clutch 3, 4 allowing the engine to be decoupled from the associated step-down geartrain, a shaft line 7 driving a screw propeller 8 with fixed blades and a brake 6 allowing the shaft line to be decelerated and held stationary.

In accordance with the invention, the apparatus for controlling the speed of a ship includes means 16 to 22 for optimizing the configuration of the drive means 15.

It follows from the above that the method of the invention comprises the known steps consisting of:

choosing a desired speed for the ship, and measuring the present speed of the ship and the parameters representing the operation of the engine, geartrain, brake, clutch and screw.

The method of the invention also comprises the following additional steps consisting of:

comparing the measured values of said present ship speed and said parameters representing the operation of the engine with the values of the same parameters which would result from compliance with the desired ship speed, and sending commands for changing the states of the engine, the brake, and the clutch as required to obtain said values of said parameters resulting from said desired ship speed, said commands for changing the states of the engine, the brake and the clutch being determined so that the performance required of the engine, the brake, or the clutch as a result does not exceed the maximum performance permitted for any of those components.

Moreover, the method is such that the values of the performance limits for the engine, the brake, and the clutch are calculated before sending each state-changing command.

For the engine, the calculation consists in determining the maximum torque which is potentially available and the law for obtaining this torque from the present state of the engine.

For the clutch and the brake, the calculation consists in determining the level of heat energy which can still be carried by these components, taking into account their present thermal state and the number of operations which they have already performed.

Finally, the method of the invention includes a clutch-engagement operation performed at the same time as an operation in which the engine torque is increased, so as to allow said engine torque to establish itself whilst minimizing the heat energy generated by the clutch.

By way of example, the input and output parameters which may be taken into account in the method for controlling the speed of a ship in accordance with the invention are given below.

The input parameters relating to at least one of the engines are, for example, the forward speed, the reverse speed, the "ahead" command, the "astern" command, engine available, engine unavailable, the injection point, the speed of the turbocompressor(s), and the supercharging air pressure.

The input parameters relating to at least one of the clutches are, for example, clutch engaged, clutch disengaged, clutch available, clutch unavailable, number of operations, temperatures of the friction members, and safety parameters.

The input parameters relating to at least one of the brakes are, for example, brake released, brake engaged, brake available, brake unavailable, number of operations, temperatures of the friction members, reaction forces on fixed parts connected to the hull, and safety parameters.

The input parameters relating to at least one of the step-down geartrains are, for example, the geartrain available, the geartrain unavailable, and safety parameters.

The input parameters relating to the screw are, for example, forward speed of the screw, and reverse speed of the screw.

The input parameters relating to the ship are, for example, speed ahead of the ship, speed astern of the ship, and displacement.

The output parameters relating to at least one of the engines are, for example, command ahead, command astern, command start, command a speed of a given value, and command a stop.

The output parameters relating to at least one of the clutches are, for example, command engagement, and command disengagement.

The output parameters relating to at least one of the brakes are, for example, command release and command engagement.

The output parameters relating to the ship are, for example, speed ahead of the ship, and speed astern of the ship.

The safety parameters for a member may be, for example, the pressure of its lubricating oil or the temperature of a bearing.

I claim:

1. A method of controlling the speed of a ship, said ship being fitted with drive means and means for optimizing the configuration of said drive means, said drive means comprising at least one reversible internal combustion engine, a speed step-down geartrain driven by said engine, a friction-type clutch allowing the engine to be decoupled from said associated step-down geartrain, a shaft line driving a screw propeller with fixed blades and a brake allowing the shaft line to be decelerated and held stationary, said method comprising the steps of:

choosing a desired speed for the ship, measuring the present speed of the ship and the parameters representing the operation of the engine, geartrain, brake, clutch and screw, and comprising the additional steps consisting of:

comparing the measured values of said present ship speed and said parameters representing the operation of the engine with the values of the same parameters which would result from compliance with the desired ship speed; and sending commands for changing the states of the engine, the brake and the clutch as required to obtain said values of said parameters resulting from said desired ship speed, said commands for changing the states of the engine, the brake and the clutch being determined so that the performance required of the engine, the brake, or the clutch as a result does not exceed the maximum performance permitted for any of those components.

2. A method according to claim 1, wherein said values of said performance limits for the engine, the brake and the clutch are calculated before sending each state-changing command, said calculation consisting, for the engine, in determining the maximum torque which is potentially available and the law for obtaining this torque from the present state of the engine, and, for the clutch and the brake, in determining the amount of heat energy which can still be carried by these components, taking into account their present thermal state and the number of operations which they have already performed.

3. A method according to claim 2, wherein a clutch engagement operation is performed at the same time as an operation in which engine torque is increased, so as to allow said engine torque to establish itself whilst minimizing the heat energy generated by the clutch.

4. An apparatus for controlling the speed of a ship, said ship being fitted with drive means comprising at least one reversible internal combustion engine, a speed step-down geartrain driven by said engine, a friction-type clutch allowing the engine to be decoupled from said associated step-down geartrain, a shaft line driving a screw propeller with fixed blades and a brake allowing the shaft line to be decelerated and held stationary, said apparatus comprising optimizing means for optimizing the configuration of said drive means, and including:

means for choosing a desired speed for the ship;

means for measuring the present speed of the ship and the parameters representing the operation of the engine, geartrain, brake, clutch and screw;

means for comparing the measured values of said present ship speed and said parameters representing the operation of the engine with the values of the same parameters which would result from compliance with the desired ship speed; and means for sending commands for changing the states of the engine, the brake and the clutch as required to obtain said values of said parameters resulting from said desired ship speed, said commands for changing the states of the engine, the brake and the clutch being determined so that the performance required of the engine, the brake, or the clutch as a result does not exceed the maximum performance permitted for any of those components.

* * * * *

UNITED STATES PATENT AND TRADEMARK OFFICE

CERTIFICATE OF CORRECTION

PATENT NO. : 5,618,211
DATED : April 8, 1997
INVENTOR(S) : Jean-Pierre Bourgoin

It is certified that error appears in the above-identified patent and that said Letters Patent is hereby corrected as shown below:

On the title page, Item [73], delete " S.E.M.I. PIELSTICK " and insert -- S.E.M.T. PIELSTICK --.

Signed and Sealed this

Twenty-seventh Day of January, 1998

*Attest:*

BRUCE LEHMAN

*Attesting Officer*

*Commissioner of Patents and Trademarks*